US006585475B1

(12) United States Patent
Marcelli

(10) Patent No.: US 6,585,475 B1
(45) Date of Patent: Jul. 1, 2003

(54) DEVICE FOR HANDLING PARTS, IN PARTICULAR SHEET METAL COILS AND APPARATUS EQUIPPED WITH SAME

(75) Inventor: Pierre Marcelli, Laveze (FR)

(73) Assignee: Rotobloc Sarl, Pirey (FR)

( * ) Notice: Subject to any disclaimer, the term of this patent is extended or adjusted under 35 U.S.C. 154(b) by 0 days.

(21) Appl. No.: 09/806,729

(22) PCT Filed: Oct. 5, 1999

(86) PCT No.: PCT/FR99/02367

§ 371 (c)(1),
(2), (4) Date: Jun. 7, 2001

(87) PCT Pub. No.: WO00/20322

PCT Pub. Date: Apr. 13, 2000

(30) Foreign Application Priority Data

Oct. 5, 1998 (FR) ..... 98 12534

(51) Int. Cl.[7] ..... B66F 9/18
(52) U.S. Cl. ..... 414/607; 414/910; 414/911
(58) Field of Search ..... 414/607, 910, 414/911

(56) References Cited

U.S. PATENT DOCUMENTS 3,409,156 A 11/1968 Mills ..... 214/620
3,498,485 A * 3/1970 Godberson ..... 414/607
3,991,893 A 11/1976 Lynch ..... 214/152

FOREIGN PATENT DOCUMENTS

| | | | | |
|---|---|---|---|---|
| FR | 2520715 | * | 8/1983 | ..... 414/607 |
| GB | 1260474 | | 1/1972 | |
| JP | 252898 | * | 2/1990 | |
| JP | 8133694 | * | 5/1996 | |
| JP | 8282962 | * | 10/1996 | |
| RU | 562505 | * | 10/1977 | ..... 414/607 |

* cited by examiner

*Primary Examiner*—Steven A. Bratlie
(74) *Attorney, Agent, or Firm*—Ohlandt Greeley Ruggiero & Perle L.L.P.

(57) ABSTRACT

The present invention is directed to a handling device for loading and unloading a sheet metal coil. The sheet metal coil may be loaded or unloaded from a storage pallet to a machine such as reel without manual handling in a safe manner for the operator and the material, using an apparatus such as a fork lift truck. This handling device has a gripping member for gripping the coil and a frame bearing the gripping member by a first pivoting pin. The handle device is mounted on a lift truck table by a second pivoting pin. The device also has a controller coupled with the frame designed to move between an inoperative position where the gripping member is placed inside a fixed mast and an operative position where the gripping member is lowered between one or more forks.

22 Claims, 10 Drawing Sheets

DEVICE FOR HANDLING PARTS, IN PARTICULAR SHEET METAL COILS AND APPARATUS EQUIPPED WITH SAME

BACKGROUND OF THE INVENTION

1. Field of the Invention

The present invention concerns a parts handling device intended for loading and unloading sheet metal coils between a storage area and a machine, for instance a reel, whereas this device is designed to be mounted on a handling apparatus having at least a fixed mast and a table moving vertically along the mast and equipped with forks.

2. Description of the Related Art

The invention applies more specifically to the handling of sheet metal coils, commonly called "coils", with a width below or equal to approximately 700 mm, but it can naturally be extended to other heavy, bulky and difficult to handle products.

These sheet metal coils are generally stored flat by the cutting companies on pallets or on planks assembled so as to make a transport support. They are stacked each upon another and separated by wood laths with variable sections, for instance 25 to 50 mm. This coils-pallet set is stored for instance in a storage frame, transported on a traditional way by a fork lift truck and placed close to the reel, which is, in this very case, a horizontal-shaft reel.

There are several techniques allowing loading such a coil on the chuck of the reel. A first technique consists of a single-rail girder equipped with a hoisting gear that allows, thanks to a sling, gripping the coil, changing its axis, i.e. tilting it by 90° in order to bring it from the vertical axis to the horizontal axis and mounting it on the chuck of the reel. This technique requires several manual interventions of the operator, which are often dangerous due to possible shocks and to the fact that the coil, which has been slit, may have sharp edges.

A second technique, which is the most widely used one, consists in gripping the coil directly with one of the forks of the lift truck. This operation requires much skill on the part of the lift truck driver, with the risk that the coil slips away from the fork and falls on the floor.

A third technique consists of equipping a lift truck with a specific gripping device, as described in the publications U.S. Pat. No. 3,991,893 and GB-A-1 260 474. Nevertheless, with this solution, the lift truck cannot be used any more for any other task, since the gripping device remains mounted permanently on said truck. This means that the operator cannot use the same lift truck to move the coil pallets and to load the coils on the reel.

Furthermore, in this very specific technical branch, most of the sheet metal coil users impose their suppliers a winding direction for the coils. For instance, the winding direction of the coil is considered correct for feeding the reel and the manufacturing line located downstream, if the underside of the coil supplied lying corresponds to the side located towards the chuck of the reel. Yet the suppliers do not always respect the coiling direction asked for by their customers. It is thus necessary to turn the coil by half a turn when it is in lifted position, with its axis horizontal. But this operation is dangerous for the operator because of the weight of the coil and the risk of the coil falling down.

The aim of the present invention is to offer a technical solution allowing one single operator, driving one single and standard apparatus such as a fork lift truck equipped with a specific handling device, to carry out the stacking of the coil pallets, the transport of the pallets close to the reel and the loading and unloading of the coils on the reel, without manual handling, in all safety for the operator and the material, and in a short time.

Another aim of the invention is to arrange the specific handling device on said lift truck in such a way that the latter can work normally with all its capacities and functions when the handling device is not in operative position.

An additional aim of the invention is to have the possibility to choose the lifting direction of the coils, in order to turn them if necessary, in particular if they are positioned upside down on the pallet, with the correct coil side on the top.

SUMMARY OF THE INVENTION

To these purposes, the invention concerns a device comprising at least a support designed to be mounted on the table of the handling apparatus in order to allow using said handling device, at least a member for gripping a coil to be handled, a frame connecting the gripping member with said support and control means, whereas the gripping member is articulated in relation to said frame on a first pivoting pin and the frame is articulated in relation to said support on a second pivoting pin, whereas the first and second pivoting pins are parallel and distant of each another in such a way that, when using the handling device, whereas the support is mounted on the table of the handling apparatus, the control means act from said support upon the frame in order to tilt it on the second pivoting pin between an operative position, in which the gripping member extends from the first pivoting pin between the forks of the handling apparatus so as to allow the gripping member to hang up the coil to be handled below the forks of the handling apparatus, and an inoperative position, in which both the gripping member and the frame are lifted above the support in order to be placed inside the mast of the handling apparatus, so as to set the forks free.

The gripping member has preferably a L-shaped hook, whose long leg is firmly attached to a lifting beam arranged parallel and on the end opposite to the small leg, and designed to rest on said forks of the handling apparatus when the handling device is in operative position, whereas the small leg is located at a lower level than the level of said forks.

The hook is advantageously designed so as to handle coils having a width at the most equal to twice the useful length of the small leg and a radial thickness at the most equal to the length of the long leg. The small leg of the hook has preferably at its end a thickness smaller than the section of the laths placed between two coils lying upon another on a pallet.

In a preferred embodiment, the lifting beam has, at each fork of the lift truck, two supporting points with an interval i between them and defining a supporting plane, whereas at least one of the supporting points can be adjusted in height.

In this embodiment, the first pivoting pin between the gripping member and the frame can be located vertically above the centre of gravity of said gripping member so as to position the hook vertically and the supporting plane horizontally, whatever the position of said frame.

The interval i between the supporting points on a same fork is preferably at least equal to the useful length of the small hook leg. This way, the vertical line passing through the centre of gravity of the coil to be handled when it is held by the hook passes between these two supporting points, which allows stabilising and stiffening in space said gripping member when it is in operative position.

The frame may include two parallel levers connected by at least one crossbeam, but it may also be designed differently.

In the preferred embodiment, the control means include at least a jack coupled on one side with the support by means of a third pivoting pin constituting a fixed point and, on the other side, with the frame by means of a fourth pivoting pin constituting a mobile point.

This fourth pivoting pin is, for example, made up of a crossbeam of said frame, located away from the second pivoting pin provided between the frame and the support, in order to create a turning moment on said frame.

This frame can include a locking element designed to lock the gripping member in the inoperative position.

The first and second pivoting pins provided respectively between the gripping member and the frame and between the frame and the support are distant by a distance at least equal to the length of the long hook leg.

In an embodiment variant, the lifting beam includes, at each fork of the lift truck, at least one supporting area at the front of said hook.

In this variant, the frame includes two parallel rods connected with each another by their pivoting pins.

The control means include preferably at least one jack coupled on one side with the support by means of a third pivoting pin constituting a fixed point and, on the other side, with the lifting beam by means of a fourth pivoting pin constituting a mobile point, so that the four pivoting pins define a deformable polygon.

The frame may include at least a tilting stop designed to abut against the lifting beam when the latter is in the tilting phase between the operative and the inoperative position.

In this embodiment, the gripping means include advantageously a rotation device of said hook designed to turn it on a rotation axis between at least a front and a rear position.

This rotation device comprises, for example, at least a jack firmly attached to the lifting beam and whose rod is firmly attached to a rack driving a pinion firmly attached to said hook.

In certain cases, the gripping member may include two hooks arranged in parallel and oriented in the same direction or in opposite directions.

The invention also concerns a handling apparatus having at least a fixed mast and a table moving vertically along the mast and bearing forks, characterised in that it includes a parts handling device as defined above.

DESCRIPTION OF THE DRAWINGS

This invention and its advantages will be understood better by the following description of two embodiments given for non-exhaustive exemplification purposes and referring to the appended drawings, in which:

Illustration 1 is a side view of a fork lift truck equipped with a handling device, Illustrations 2A and 2B are respectively a side and a front view of the handling device and of a part of the lift truck, Illustrations 3A and 3B are views similar to illustrations 2A and 2B with the handling device in intermediate position, Illustrations 4A and 4B are views similar to illustrations 2A and 2B with the handling device in operative position, Illustrations 5A to J are schematic views showing the various steps of the loading of a coil on a horizontal-shaft reel, Illustration 6 is a side view of a fork lift truck equipped with the other handling device, Illustrations 7A and 7B are respectively a side and a front view of the handling device of illustration 6 in inoperative position and of a part of the lift truck, Illustrations 8A and 8B are views similar to illustrations 7A and 7B with the handling device in operative position, Illustration 9 is a top view of illustration 6, Illustrations 10A to Q are schematic views showing the various steps of the loading of a coil on a horizontal-shaft reel using the device of illustration 6.

DETAILED DESCRIPTION OF THE PREFERRED EMBODIMENT

Figure 1:
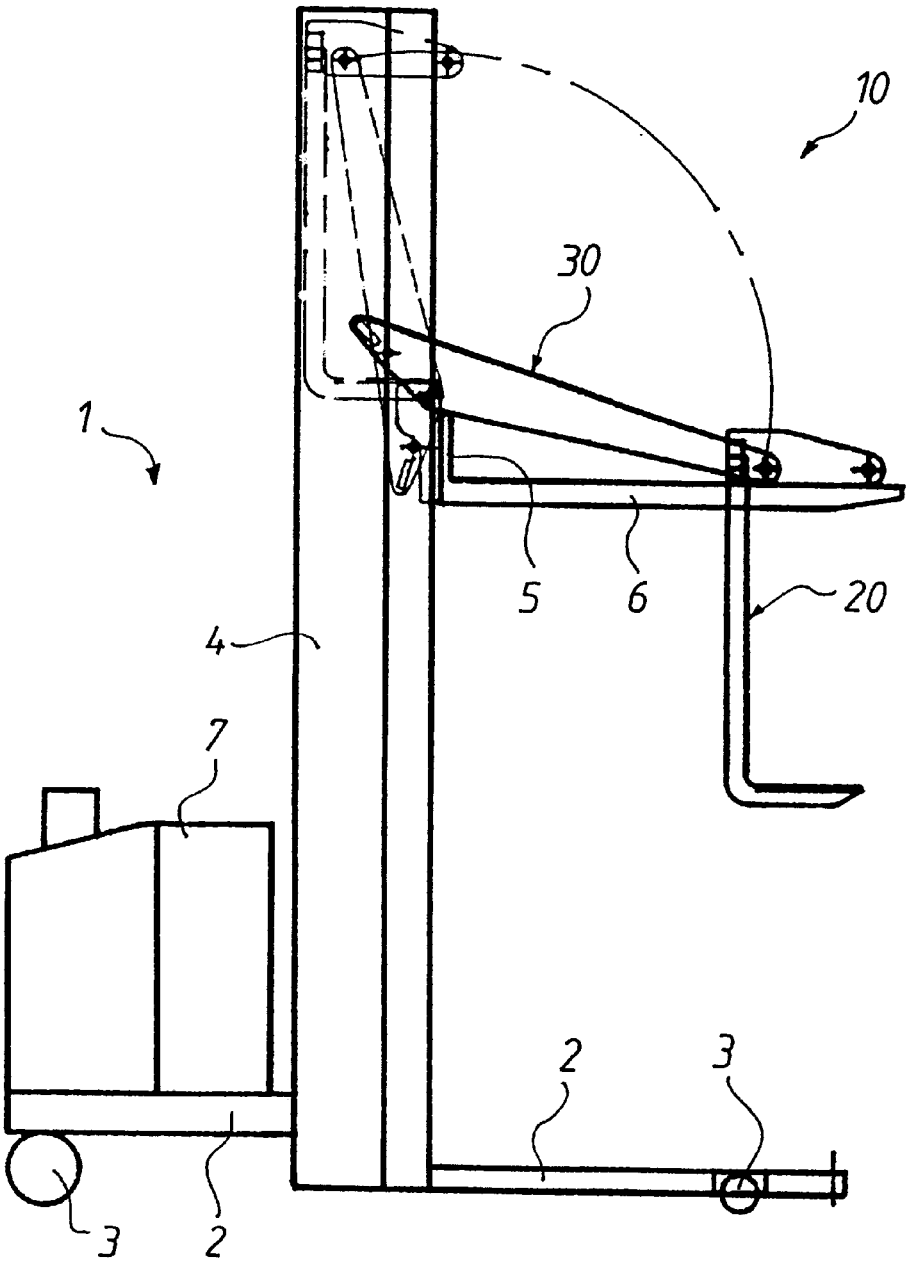
Figure 2B:
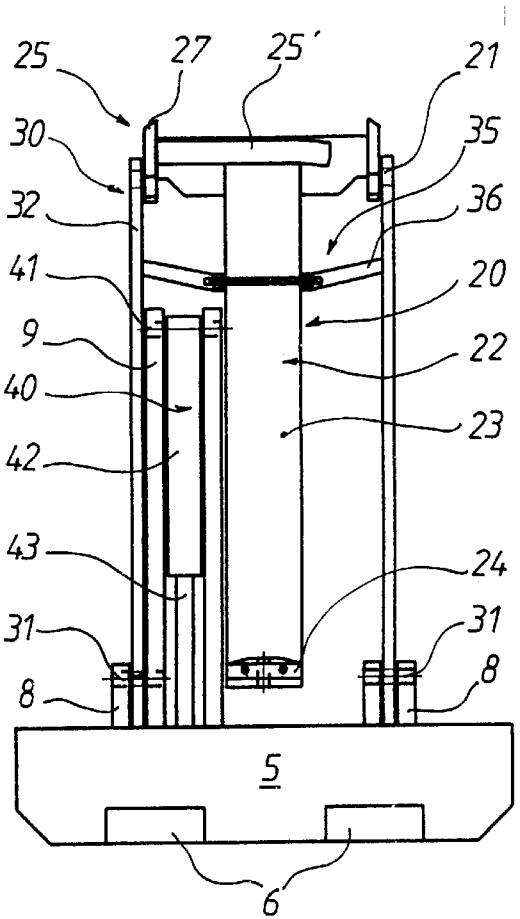
Figure 2A:
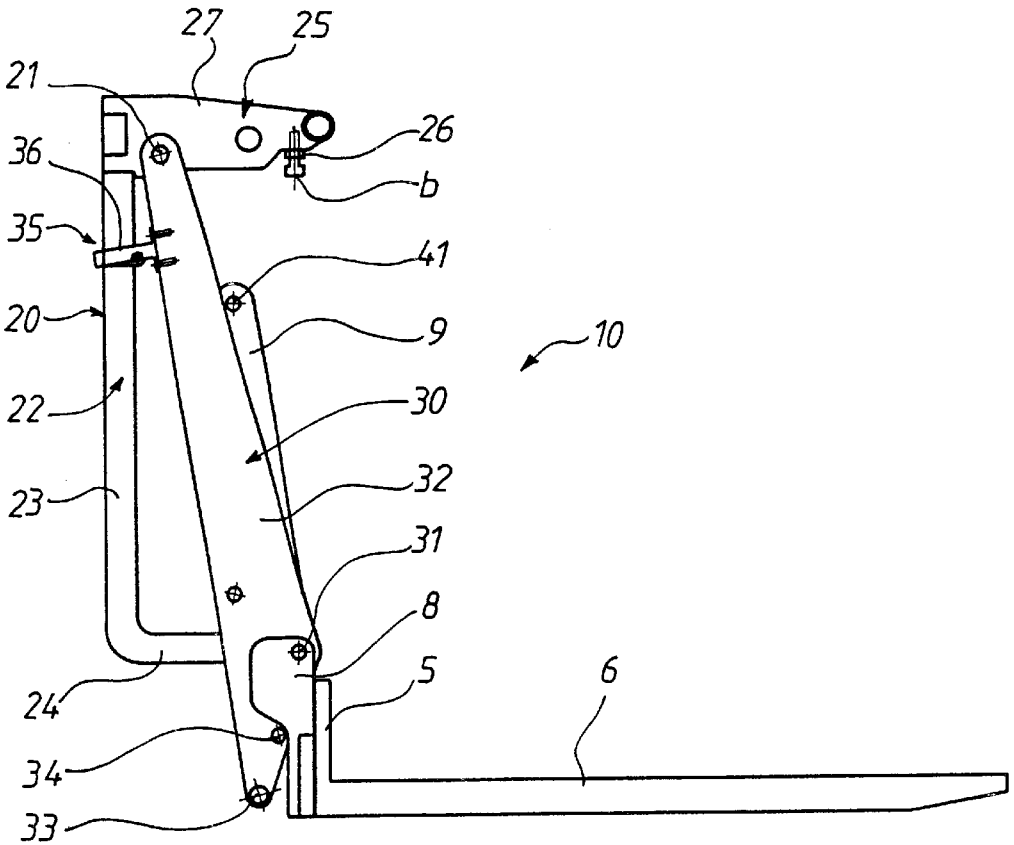
Figure 3B:
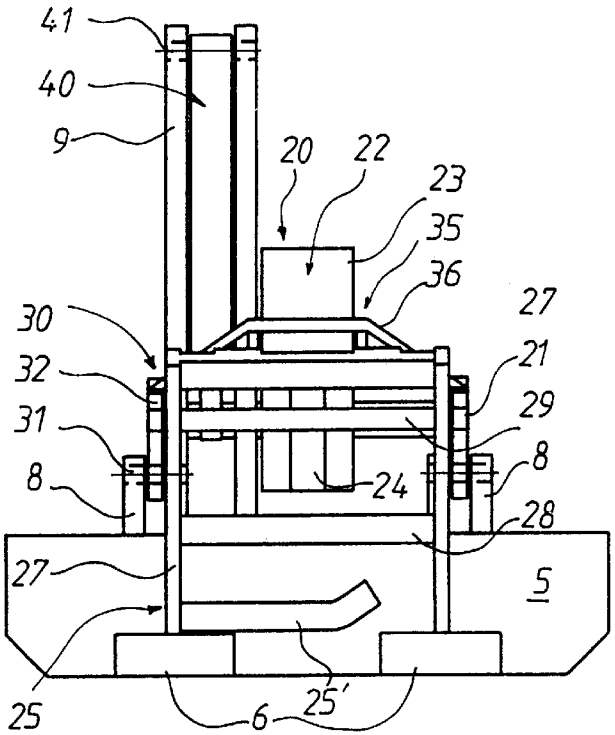
Figure 3A:
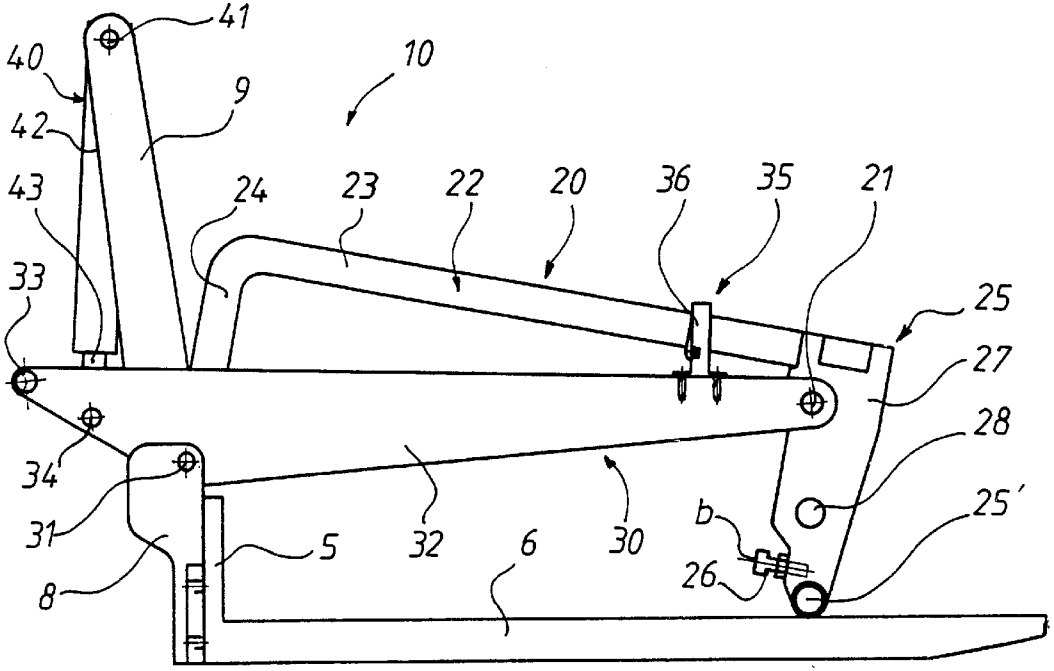
Figure 4B:
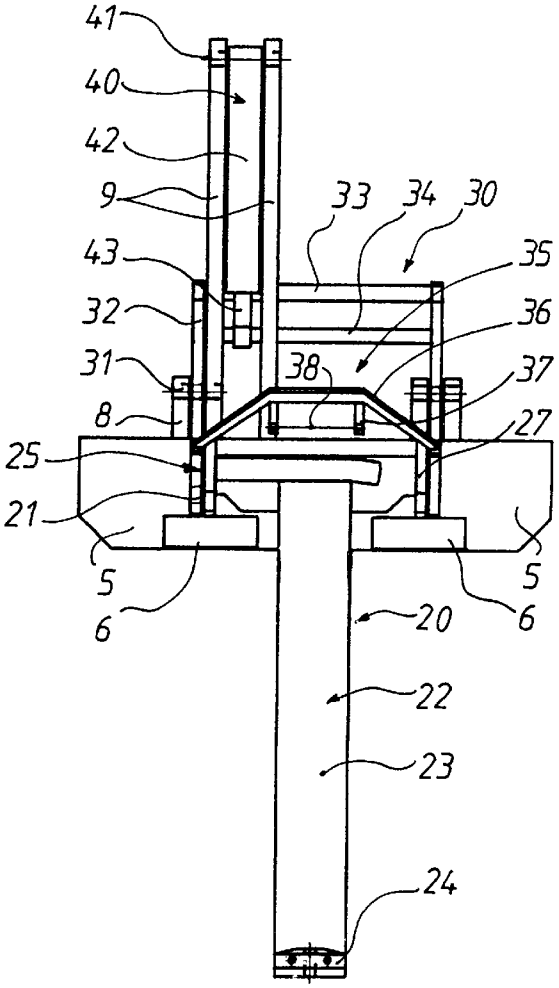
Figure 4A:
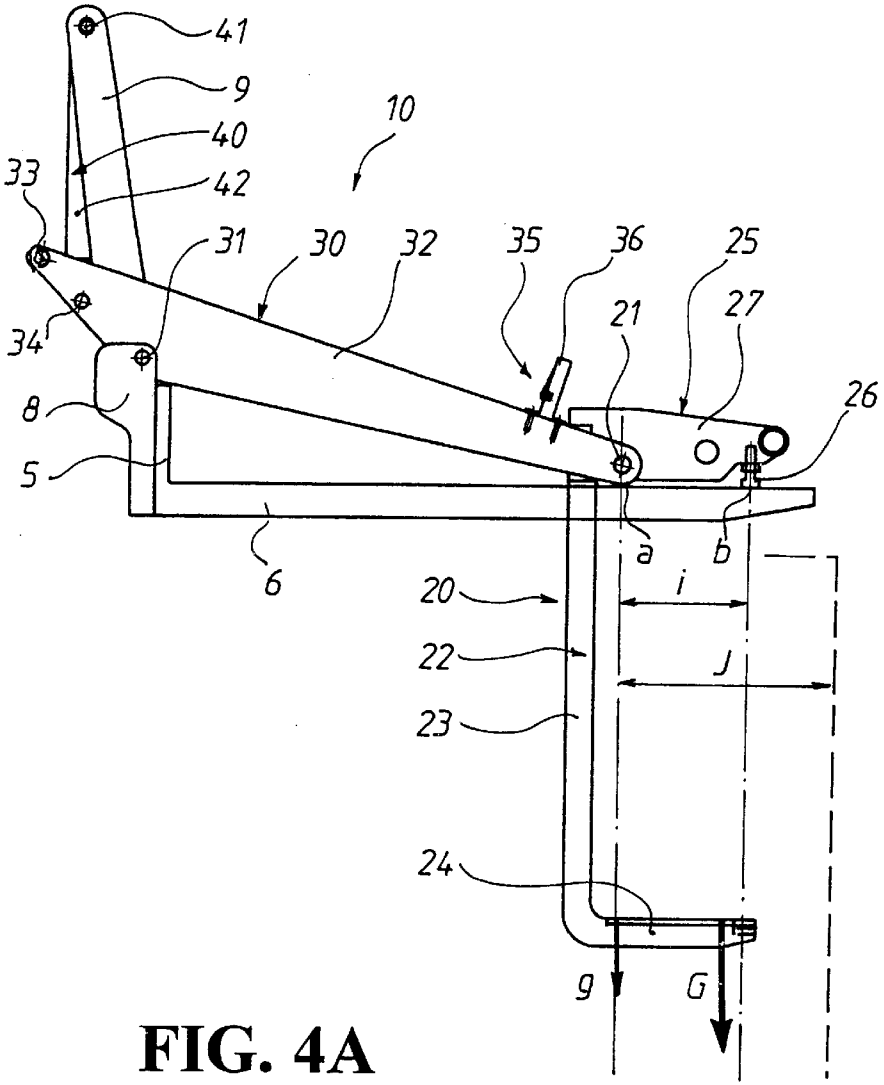
Figure 5A:
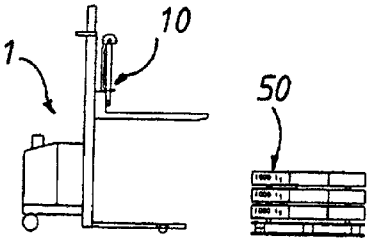
Figure 5B:
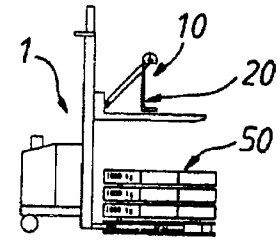
Figure 5C:
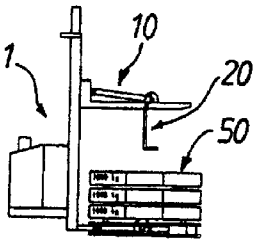
Figure 5D:
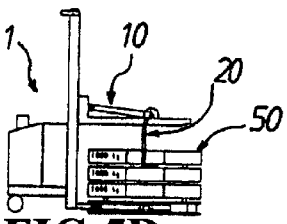
Figure 5E:
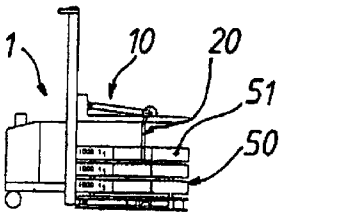
Figure 5F:
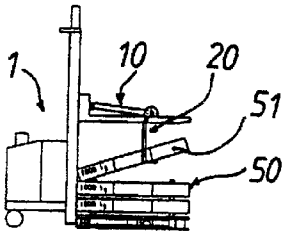
Figure 5G:
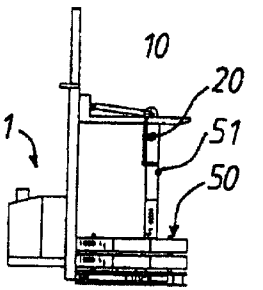
Figure 5H:
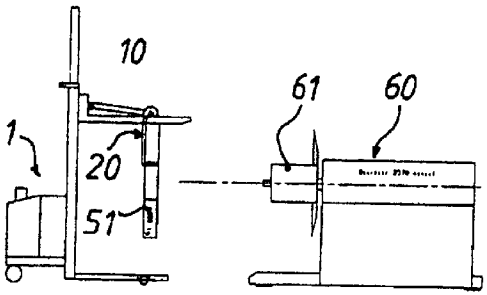
Figure 5I:
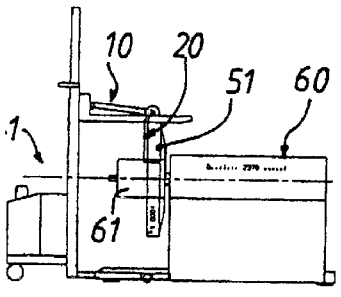
Figure 5J:
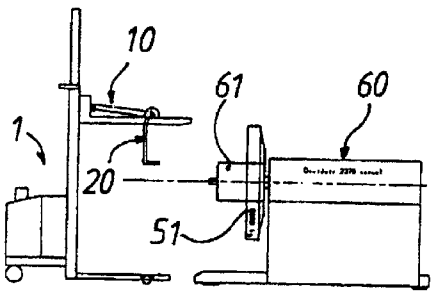
Figure 6:
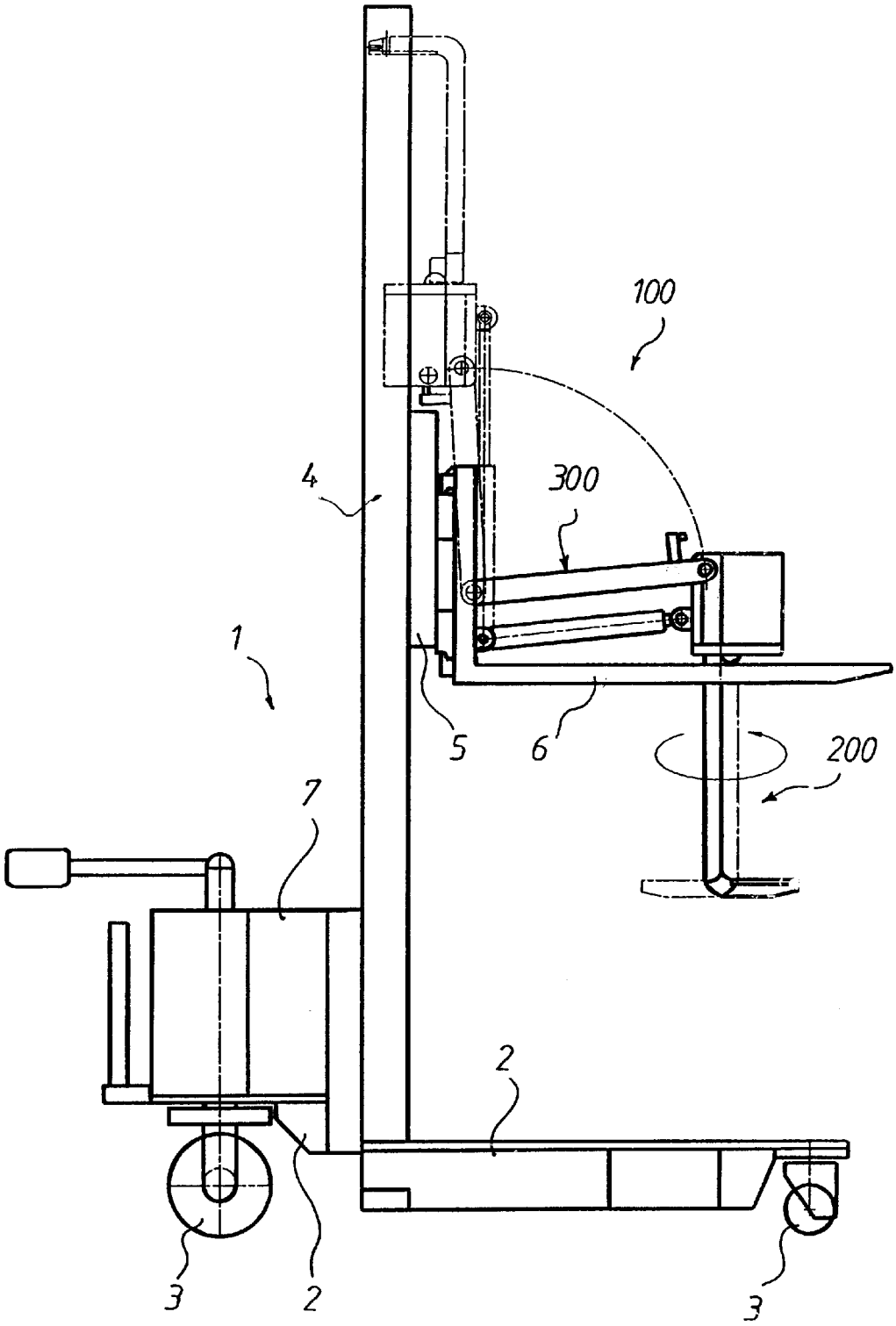
Figure 7B:
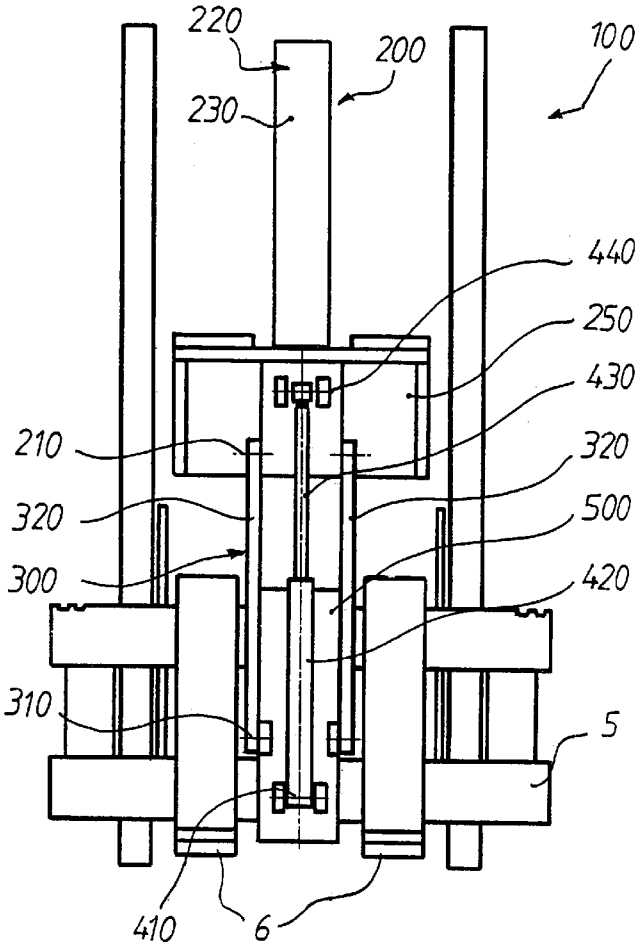
Figure 7A:
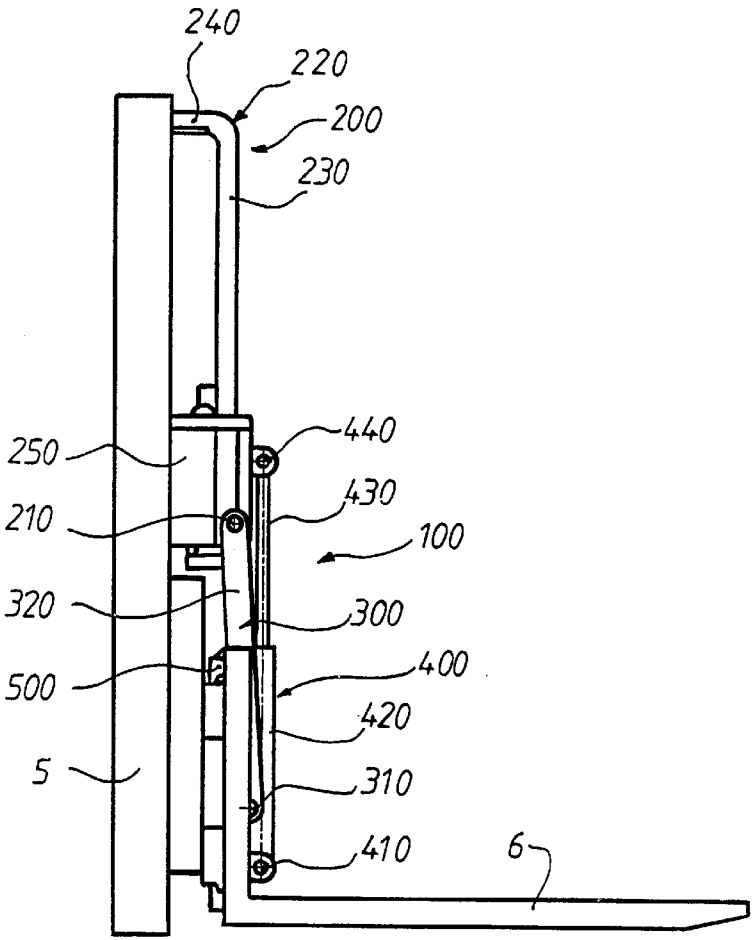
Figure 8B:
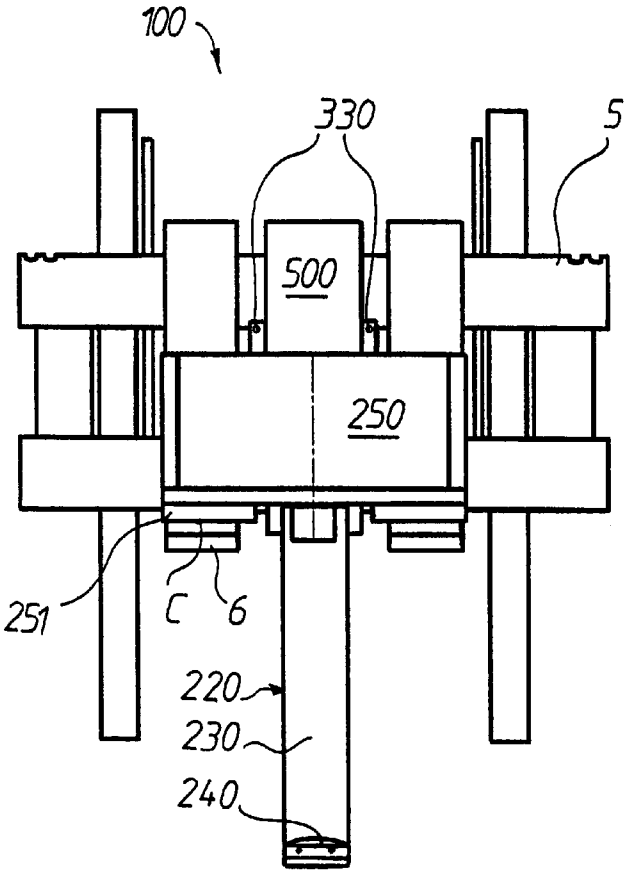
Figure 8A:
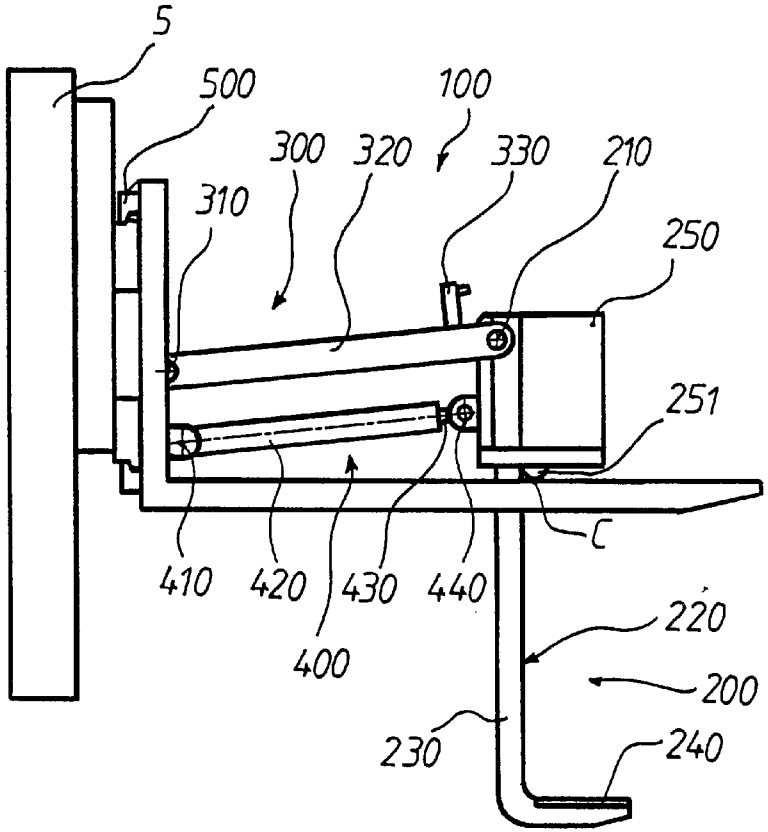
Figure 9:
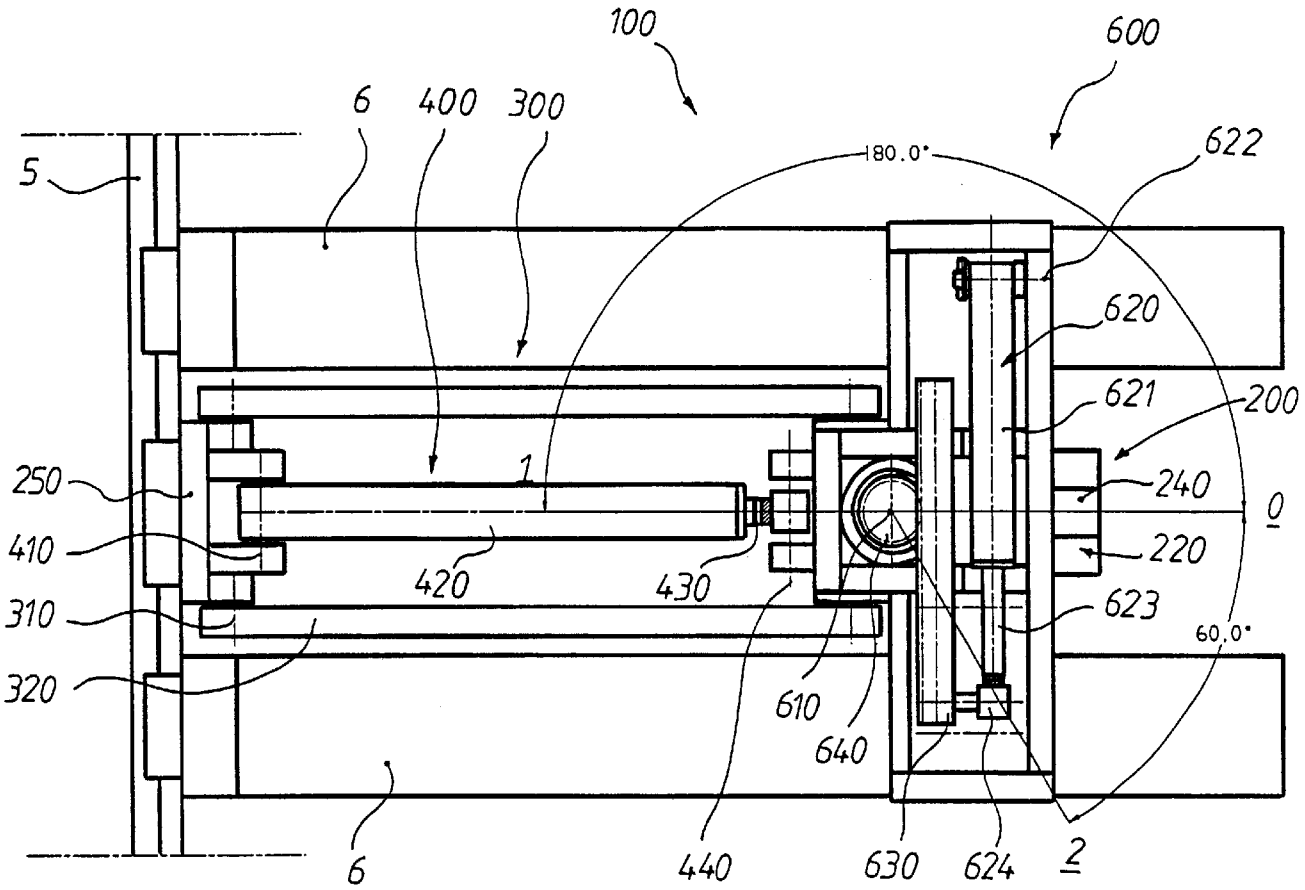
Figure 10A:
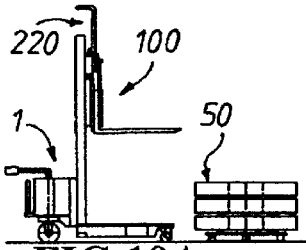
Figure 10B:
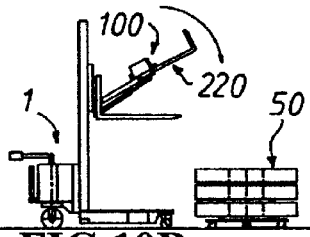
Figure 10C:
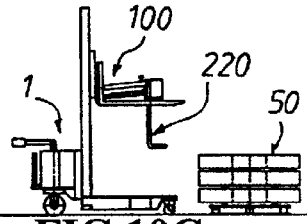
Figure 10D:
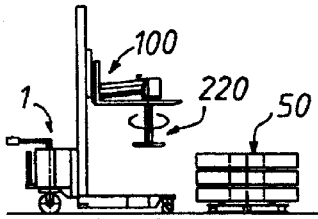
Figure 10E:
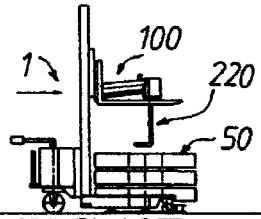
Figure 10F:
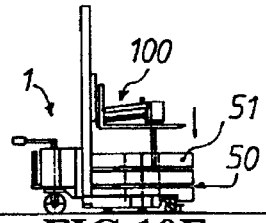
Figure 10G:
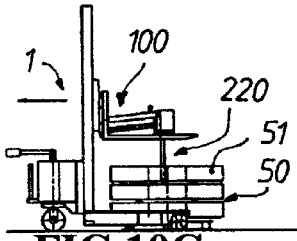
Figure 10H:
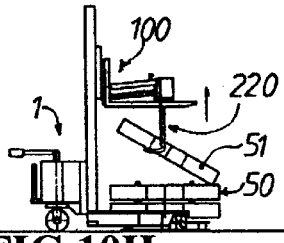
Figure 10I:
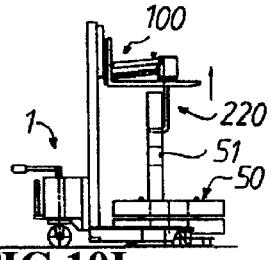
Figure 10J:
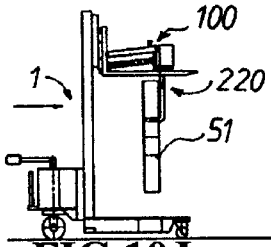
Figure 10K:
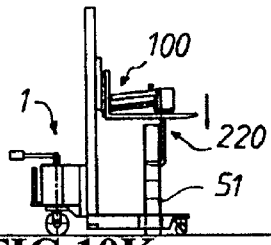
Figure 10L:
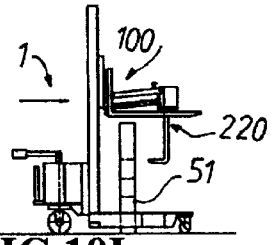
Figure 10M:
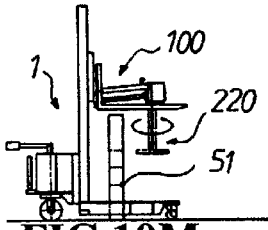
Figure 10N:
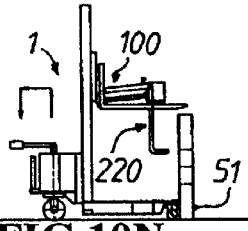
Figure 10O:
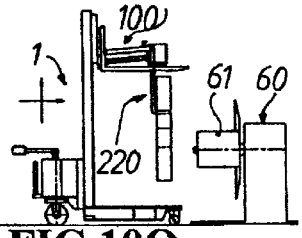
Figure 10P:
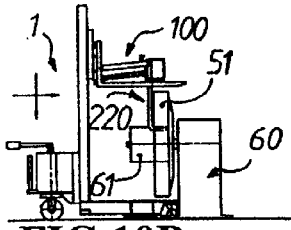
Figure 10Q:
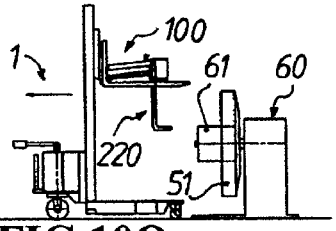

With reference to illustration 1, the lift truck 1 represented is of the known type and comprises a chassis 2 mounted on small wheels 3, a fixed mast 4 in which is mounted a vertically moving table 5 bearing a couple of parallel forks 6. This truck 1 also comprises a motorization and a driver stand 7 equipped with a control panel and the steering wheel. This lift truck 1 is equipped with a handling device 10 specially designed to load and unload sheet metal coils, commonly called "coils" between a storage area and a horizontal-shaft type machine called reel. This handling device 10 is shown on this illustration both in operative position (continuous lines) and in inoperative position (dashed lines). It is placed above table 5 and forks 6. In its operative position, it is lowered on forks 6 and, in its inoperative position, it is lifted up and disappears completely in mast 4 in order not to hinder the standard operation of said lift truck 1.

This handling device 10 is described more precisely with reference to illustrations 2 to 4 in which only a part of lift truck 1 is represented, i.e. the forks 6 and the table 5. The handling device 10 comprises a gripping member 20, a frame 30 bearing said gripping member 20 by means of a first pivoting pin 21, whereas this frame is mounted on table 5 of the fork lift by means of a second pivoting pin 31. The handling device 10 also comprises control means 40 coupled to said frame 30 and designed to move it between an inoperative position represented in illustrations 2A and 2B, in which the whole handling device 10 is lifted inside said lift truck mast and an operative position represented in illustrations 4A and 4B, in which it is lowered, whereas the gripping member 20 is positioned between the forks 6 of said truck. Illustrations 3A and 3B represent an intermediate position of handling device 10.

The gripping member 20 includes an L-shaped hook 22 whose long leg 23 is arranged vertically in operative position and whose small leg 24 is perpendicular to the long leg 23. This small leg 24 has a useful length at least equal to the width J of the coils to be handled, an end that becomes thinner so that its tip is thinner than the section of the laths placed between two coils lying upon another and a width smaller than the space provided between two consecutive jaws of the chuck provided on the reel and intended to receive the coils. The long leg 23 has a length approximately equal to the radial thickness of said coils. The gripping member 20 also includes a lifting beam 25 firmly attached to the long leg 23 and placed on the end opposite to the small leg 24, parallel to it. The pivoting pin 21 that links gripping member 20 to frame 30 is provided in lifting beam 25 close to hook 22 and placed vertically above the centre of gravity g of said gripping member 20. This way, the gripping member 20 is pivoting on said frame 30 on this pin 21 and keeps a vertical position whatever the position of said frame 30. When the gripping member 20 is in operative position, the hook 22 is placed between forks 6 of the lift truck so that the small leg 24 is positioned far below them and the lifting beam 25 rests on these forks 6 to stabilise and stiffen said gripping member 20. To that purpose, the lifting beam 25 includes at least two and preferably four supporting points a, b, i.e. two supporting points for each fork, defining a supporting plane. This supporting plane always remains horizontal, whatever the position of frame 30, thanks to the position of pivoting pin 21. Since the forks 6 are distant, the four supporting points a and b ensure a strict and constant position of gripping member 20, as well as a perfect orientation rigidity in space. The two supporting points a, b of a same fork 6 are distant by an interval i at least equal to half the width J of the coils to be handled. Consequently, the vertical line passing through the centre of gravity G of the coil when it is hanging on hook 22 passes between the two supporting points a and b, which ensures a very good stability and rigidity in space of hook 22 and of its load. In the embodiment shown, the supporting point a is fixed and the supporting point b is adjustable in height by means of a screw-nut set 26 that allows adjusting the horizontal position of said supporting plane.

The gripping member 20 as it is described above suits for a reel spindle whose chuck jaws are arranged so as to leave a vertical free space to allow introducing hook 22. If the chuck jaws are offset by 45°, the gripping member 20 is designed with two parallel hooks 22, whereas these hooks are intended to be introduced on both sides of the jaw placed vertically on the spindle. Naturally, this modification does not change the other components of the device.

The lifting beam 25 includes two parallel arms 27 connected together by at least one crossbeam and, in the example shown, by two crossbeams 28, 29. The pivoting pin 21 corresponds to crossbeam 29. In addition, this lifting beam 25 comprises a supporting rod 25' designed to rest on forks 6 of the lift truck and ensures the guidance of handling device 10 in intermediate position, as shown on illustrations 3A and 3B.

The frame 30 has two parallel levers 32 linked together by means of at least one crossbeam and, in the example shown, by two crossbeams 33, 34 placed on the side opposite to pivoting pin 21 and behind table 5 and pivoting pin 31. These levers 32 have approximately the shape of a very long triangle, whereas the pivoting pin 31 connecting frame 30 to lift truck table 5 is placed in the area of the vertex of said levers 32. To that purpose, table 5 comprises vertical feet 8 between which levers 32 are maintained and guided. In addition, frame 30 includes a locking element 35 provided with a rod 36 making a bridge between both levers 32 close to the pivoting pin 21 and equipped with two protruding and parallel tabs 37 connected together by a removable fastener 38. The distance between tabs 37 is at least equal to the width of hook 22 allowing the latter to lodge itself in it and to be held in place by the fastener 38, whose mounting can be manual or automatic by means of a control button provided on the control panel of the lift truck.

In the example shown, the control means 40 include a single-action or double-action jack whose body 42 is mounted on table 5 of the lift truck by means of a pivoting pin 41 between two vertical stanchions 9 firmly fastened to said table. This pivoting pin 41 constitutes a fixed point. The rod 43 of the jack is firmly coupled to frame 30 and more precisely to crossbeam 34, constituting a mobile point. Since crossbeam 34 is located at a distance from the pivoting pin 31 provided between frame 30 and table 5, the jack 40 can apply a turning moment on said frame 30. This jack 40, which may be hydraulic or pneumatic, is controlled by means of a suitable lever provided on the control panel of said lift truck. This way, the operator can operate the handling device 10 from his driver stand.

The operation of this handling device 10 is now described with reference to illustrations 5A to J, which represent on schemas all operating steps allowing to load a sheet metal coil in the chuck of a horizontal-spindle uncoiling machine called reel:

- illustration 5A: the lift truck 1 fetches a set 50 made up of a pallet with sheet metal coils in a storage area and transports it next to a reel 60, whereas the handling device 10 is in inoperative position,
- illustration 5B: the operator actuates the control lever, which may be hydraulic, provided on the control panel to bring the handling device 10 down in its operative position,
- illustration 5C: the handling device 10 is in operative position, whereas the jack can be locked in this position by any known means,
- illustration 5D: the operator lowers table 5 of the lift truck to bring gripping member 20 down inside the first coil 51,
- illustration 5E: the operator moves the lift truck 1 slightly forward to insert the small leg of hook 22 under the first coil 51. This operation only is possible thanks to the rigidity of hook 22 in space, which is obtained, as explained above, by the lifting beam 25 resting on forks 6.
- illustration 5F: once in position, the operator rises table 5 to lift the coil 51, which turns due to gravity,
- illustration 5G: the coil 51 turned by 90°. It is now vertical and its axis is horizontal, in a correct loading position,
- illustration 5H: the operator removes the lift truck 1 from the pallet and approaches the reel 60 while carrying the ready-to-load coil,
- illustration 5I: the operator moves the lift truck 1 in the axis of reel 60 to place coil 51 on chuck 61 of the reel. The small width of the small leg 24 of hook 22 allows it passing directly between the jaws of the chuck.
- illustration 5J: once loading is completed, the operator moves the lift truck 1 back to release gripping member 20 from chuck 61 of the reel.

Then, the initial functions of the lift truck are restored when the operator lifts the handling device 10 in inoperative position. If the coil is not completely processed, after hooping it again, the operator can, driving his lift truck, take out coil 51 from chuck 61 of reel 60 and put it aside. To do so, simply carry out the above steps in the reverse order.

This handling device 10 suits in particular for lift trucks having the following characteristics:

- they must comprise two lifting jacks arranged on the outside of the mast profiles so that the central area be free, which excludes the lift trucks equipped with a central lifting jack,
- the depth of the mast must be close to that of hook 22, which corresponds at least to half the width of the coils to be handled so that, in inoperative position, the handling device 10 does not protrude from the vertical plane defined by table 5,
- the lift truck must allow placing the pallet-coils set 50 under the forks 6, the lower side bars firmly attached to the mast must thus be compatible with the dimensions of the pallet.

With reference to illustrations 6 to 10, we describe another embodiment of a handling device 100 having additional advantages in comparison with the above-described handling device 10, which are:

- a universal handling device that can be mounted on standard lift trucks without any structure modification,
- a retractable handling device suitable for a mast with a small width,
- a handling device allowing turning the coils without any operation and without danger for the operator.

Illustration 6 shows a lift truck 1 of the known type, similar to that of illustration 1 and bearing the same reference numbers. The handling device 100 mounted on this lift truck 1 is represented on this illustration both in operative position (continuous line) and in inoperative position (dashed line). As in the previous example, it is located above table 5 and forks 6. In its operative position, it is lowered on forks 6 and, in its inoperative position, it is lifted up and disappears completely in mast 4 in order not to hinder the standard operation of said lift truck 1.

This handling device 100 is described more precisely with reference to illustrations 7 to 9 in which only a part of lift truck 1 is represented, i.e. the forks 6 and the table 5. The handling device 100 includes a gripping member 200, a frame 300 bearing said gripping member 200 by means of a first pivoting pin 210, whereas this frame is mounted on table 5 of the fork lift by means of a second pivoting pin 310. More precisely, a base plate 500 is rigidly mounted on table 5 between the two forks 6 and is provided with bearings receiving the second pivoting pin 310. This base plate 500 is specially designed to be compatible with the dimensions of the standard tables and to be mounted on these tables without any modification.

The handling device 100 also comprises control means 400 coupled to said gripping member 200 and designed to move it between an inoperative position represented in illustrations 7A and 7B, in which the whole handling device 100 is lifted inside said lift truck mast and an operative position represented in illustrations 8A and 8B, in which it is lowered, whereas the gripping member 200 is positioned between the forks 6 of said truck.

The gripping member 200 comprises a L-shaped hook 220 whose long leg 230 is arranged vertically in operative position and the small leg 240 is perpendicular to the long leg 230, whereas this hook 220 is similar to hook 22 described previously. The gripping member 200 also comprises a lifting beam 250 coupled to the long leg 230 and placed on the end opposite to the small leg 240, parallel to it. The pivoting pin 210 that connects gripping member 200 and frame 300 is provided in the lifting beam 250 as a continuation of the long leg 230 of hook 220.

When the gripping member 200 is in operative position, the hook 220 is placed between forks 6 of the lift truck so that the small leg 240 be positioned far below them and the lifting beam 250 rests on these forks 6 to stabilise and stiffen said gripping member 200. To that purpose, the lifting beam 250 comprises at least two supporting areas c, this is one supporting area per fork, each of them formed by the generating line of a half-cylinder 251 oriented perpendicular to forks 6 and placed before hook 220.

The frame 300 is made up of two parallel levers 320 linked together by means of their pivoting pins 210 and 310. These levers 320 are placed on both sides of the base plate 500 and between the forks 6.

In the example shown, the control means 400 include a double-action jack whose body 420 is mounted on base plate 500, which is firmly attached to table 5, by means of a pivoting pin 410 constituting a fixed point. The rod 430 of the jack is coupled to lifting beam 250 by means of a pivoting pin 440 constituting a mobile point. This double-action jack 400 is placed between the two levers 320, parallel to them and below them. The pivoting pins 410 and 440 are respectively distinct from the pivoting pins 310 and 210, whereas these four pivoting pins define a deformable polygon.

In operative position (see illustration 8A), the rod 430 of the jack is retracted, arrested against a limit stop, and the unit formed by the jack 400, the base plate 500, the levers 320, the lifting beam 250 with the hook 220 is rigid and dimensionally stable. Even in case of an important deflection of forks 6, the inclination of hook 220 changes very little thanks to the geometry of the polygon.

To bring the gripping system 100 in inoperative position (see illustration 7A), the rod 430 of the jack is moved out, arrested against a limit stop. At the beginning of its stroke, rod 430 pivots lifting beam 250 with hook 220 on pivoting pin 210 by approximately a quarter turn until it comes in contact with a tilting stop 330 firmly attached to levers 320. Continuing on its stroke, rod 430 tilts the unit formed by the levers 320 and the lifting beam 250 with the hook 220 on pivoting pin 310 until said unit is retracted inside the mast of the lift truck. The operative position of the handling device 100 is reached retracting rod 430 of the jack, driving said unit in the opposite direction.

This jack 400, which may be hydraulic or pneumatic, is controlled, as in the previous example, by means of a suitable lever provided on the control panel of said lift truck. This way, the operator can operate the handling device 100 from his driver stand.

The handling device 100 comprises, in addition to the one described in the previous example, a rotation device 600 of hook 220 shown in illustration 9. This rotation device 600 is provided inside lifting beam 250 and aims to rotate hook 220 on a rotation axis 610 parallel to its large leg 230 between two end positions 1 and 2, passing through an intermediate position 0, represented in illustration 9 by dot-and-dash lines. It includes a double-action jack 620 whose body 621 is fastened onto lifting beam 250 at a fixed point 622 and whose rod 623 is rigidly coupled with a rack 630 by means of a rigid coupling 624. The rack 630 is arranged parallel to the axis of jack 620 so that a linear movement of rod 623 leads to an equal movement of the rack. The latter drives a pinion 640 firmly fastened on hook 220 and coaxial with its rotation axis 610.

This jack 620, which may be hydraulic or pneumatic, is also controlled by means of a suitable lever provided on the control panel of said lift truck. This way, the operator can operate the rotation device 600 of hook 220 from his driver stand to place it, according to the needs, in positions 0, 1 or 2. In position 0, the small leg 240 of hook 220 is oriented towards the front, as shown in continuous lines in illustration 6. In position 1, the hook 220 is turned by 180° and its small leg 240 is oriented towards the back, shown in dot-and-dash lines in illustration 6. In position 2, the hook 220 is turned by 60° with respect to its position 0, whereas this angle may be different if necessary. This position 2 can be used in particular when the reels are arranged at an angle to facilitate loading and unloading the coils.

The operation of handling device 100 is now described with reference to illustrations 10A to Q, which represent on schemas all operating steps allowing to load a sheet metal coil in the chuck of a horizontal-spindle uncoiling machine called reel. In this example, one or more sheet metal coils are placed upside down on the pallet and must imperatively be turned to be loaded on the reel in the correct winding direction, with the correct side placed against the chuck illustration 10A: the operator 1 fetches with his lift truck 1 a set 50 made up of a pallet with sheet metal coils in a storage area and transports it next to a reel 60, whereas the handling device 100 is in inoperative position, illustration 10B: the operator brings the handling device 100 to its operative position by actuating the control lever, provided on the control panel, of jack 400, which may be hydraulic, illustration 10C: the handling device 100 is in operative position, whereas rod 430 of the jack is retracted, illustration 10D: the operator turns the empty hook 220 by 180° to place the small leg 240 of the hook towards the back by actuating the control lever, provided on the control panel, of jack 620, which may be hydraulic, illustration 10E: the operator moves the lift truck 1 forward to bring hook 220 above pallet 50, illustration 10F: the operator lowers table 5 of lift truck 1 to bring hook 220 down inside the first coil 51, illustration 10G: the operator moves the lift truck 1 slightly back to push the small leg 240 of hook 220 under the first coil 51. This operation only is possible thanks to the rigidity of hook 220 in space, which is obtained, as explained above, by the lifting beam 250 resting on the forks 6, the levers 320, the base plate 500 and the jack 400.

illustration 10H: once in position, the operator rises table 5 to lift coil 51, which turns due to gravity.

illustration 10I: the coil 51 turned by 90°. It is now vertical and its axis is horizontal.

illustration 10J: the operator removes lift truck 1 from pallet 50, illustration 10K: the operator lowers again table 5 to put coil 51 on the floor on a generating line, illustration 10L: the operator moves lift truck 1 slightly forward to clear hook 220 from coil 51, illustration 10M: the operator turns the empty hook 220 by 180° in the opposite direction to place the small leg 240 of the hook back towards the front, illustration 10N: the operator moves lift truck 1 forward to engage again hook 220 in coil 51, illustration 10O: the operator rises again table 5 and moves lift truck 1 carrying coil 51 ready for loading towards reel 60, whereas the coil shows the correct side, illustration 10P: the operator moves lift truck 1 in the axis of reel 60 to place coil 51 on chuck 61 of the reel. The small width of the small leg 240 of hook 220 allows it passing directly between the jaws of the chuck.

illustration 10Q: once loading is completed, the operator moves lift truck 1 back to release hook 220 from chuck 61 of the reel.

This operating process may be different according to the mode of presentation of the coils. It is for instance possible to load the coil from the front, to turn the hook bearing the coil, to put the coil on the floor, to turn the empty hook and to grip the coil again to load it on the reel.

Then, the initial functions of lift truck 1 are restored when the operator lifts handling device 100 in inoperative position. If the coil is not completely processed, after hooping it again, the operator can, driving his lift truck, take out coil 51 from chuck 61 of reel 60 and put it aside. To do so, simply carry out the above steps in the reverse order.

This handling device 100 suits easily and without structure modification to lift trucks with standard tables, whereas the lifting jack may be located inside the profiles of the mast, and whereas the mast may have a reduced thickness since the hook, in retracted position, is turned.

This description shows clearly that the invention allows obtaining the following advantages:

reduction of the handling means in the sheet metal cutting workshop, considering that one single apparatus is sufficient to:
unload the trucks,
load the coil pallets in the storage frames,
load the chucks of horizontal-shaft reels,
handle the various pallets and containers of the workshop, reduction of the loading times of the horizontal-shaft reels thanks to the instantaneous switching from a universal apparatus to a specific apparatus for loading chucks and vice-versa, simply by actuating a lever on the control panel, modification as required of the cutting lines, since the handling means have no influence on the structure of the building.

It also appears clearly that handling means 10 and 100 may be mounted directly by lift trucks manufacturers or may be offered on an after-sales base to retrofit operating lift trucks. They may also equip other machines or devices to load and unload other types of parts.

This invention is not limited to the embodiment examples described therein, but extends to any modification and variation obvious to the man of the art. In particular, the number and shape of the parts may vary. The same way, the control means may include two jacks or other equivalent means like a motor, a rack-pinion system, etc. The gripping member may also include two hooks placed parallel and oriented in the same direction or in opposite directions.

What is claimed is:

1. A parts handling device for loading and unloading a sheet metal coil and capable of being mounted on a handling apparatus, the device comprising:

a fixed mast;

a table having a plurality of forks, said table being adapted to move vertically along said fixed mast;

a support being mounted on said table;

a gripping member for gripping the sheet metal coil;

a controller being disposed on said support;

a frame for connecting said gripping member with said support and said controller such that said gripping member articulates in relation to said frame on a first pivoting pin and said frame articulates in relation to said support on a second pivoting pin, said first and said second pivoting pins being parallel and distant of each other such that said support is mounted on said table of the handling apparatus;

said controller acting from said support and upon said frame for tilting said frame about said second pivoting pin between an operative position such that said gripping member extends from said first pivoting pin between said plurality of forks for allowing said gripping member to hang up the sheet metal coil below said plurality of forks, and an inoperative position, wherein both said gripping member and said frame are lifted above said support for placement in said fixed mast thereby setting free said plurality of forks.

2. The device according to claim 1, wherein the gripping member is a hook having a substantially L-shape and further comprises a first leg connected to a lifting beam arranged at an end opposite to a second leg, said first leg resting on said plurality of forks in said operative position, whereas said second leg is located at a level that is lower than a height of said plurality of forks.

3. The device according to claim 2, wherein said hook grips the sheet metal coil, said hook having a width about equal to twice a length of said second leg and a radial thickness that is substantially equal to a length of said first leg.

4. The device of claim 2, wherein said second leg has an end with a tip, said tip having a thickness that is smaller relative to a section of a lath.

5. The device of claim 2, wherein said lifting beam further comprises at least two supporting points having an interval disposed therebetween defining a supporting plane.

6. The device of claim 5, wherein at least one supporting point of said lifting beam at each of said plurality of forks is adjustable in height.

7. The device of claim 5, wherein said first pivoting pin is disposed vertically above a center of gravity of said gripping member for positioning said hook vertically and said supporting plane horizontally whatever position said frame is disposed in.

8. The device of claim 5, wherein said interval is at least equal to a length of said second leg.

9. The device of claim 2, wherein said first and said second pivoting pins are disposed parallel and distant of each other by a distance that is at least substantially equal to a length of said first leg.

10. The device of claim 2, wherein said lifting beam further comprises at each of said plurality of forks at least one supporting area at a front of said hook.

11. The device of claim 2, wherein said gripping member further comprises a rotation device adapted to turn said hook on a rotation axis between a frontal position and a rear position.

12. The device of claim 11, wherein said rotation device further comprises at least one jack firmly attached to said lifting beam and a rod attached to a rack, said rack driving a pinion attached to said hook.

13. The device of claim 2, wherein said gripping member further comprises at least two hooks being disposed in parallel and oriented in a direction selected from the group consisting of an orientation where said at least two hooks being disposed in opposite directions, an orientation where said at least two hooks are disposed pointing in a substantially same direction, and any combination thereof.

14. The device of claim 1, wherein said frame further comprises at least two levers being linked together by at least one cross beam, said at least two levers being disposed substantially parallel with respect to one another.

15. The device of claim 1, wherein said controller comprises at least one jack having a first and a second side, said at least one jack being connected in a fixedly manner with said support by a third pivoting pin on said first side and connected in a mobile manner to said frame by a fourth pivoting pin on said second side.

16. The device of claim 15, wherein said fourth pivoting pin is disposed between said jack and said frame and further comprises a crossbeam disposed at a distance from said second pivoting pin and between said frame and said support.

17. The device of claim 1, wherein said frame further comprises a locking device for locking said gripping member in said inoperative position.

18. The device of claim 1, wherein said frame further comprises at least two levers disposed parallel to one another and linked to one another by said first and said second pivoting pins.

19. The device of claim 18, wherein said controller further comprises at least one jack fixedly connected on a first side with said support by a third pivoting pin and connected on a second side with a lifting beam by a fourth pivot pin being a mobile point.

20. The device of claim 19, wherein said first pivoting pin, said second pivoting pin, said third pivoting pin and said fourth pivoting pin are arranged in a manner to form a substantially deformable polygon.

21. The device of claim 20, wherein said frame further comprises at least one tilting stop member abutting against said lifting beam when said lifting beam is in a tilting phase that is in a range that includes from said operative position to said inoperative position.

22. The device of claim 1, wherein said table moves vertically along said fixed mast and further comprises one or more bearing forks.

* * * * *